United States Patent [19]

Prager

[11] Patent Number: 4,551,106

[45] Date of Patent: Nov. 5, 1985

[54] LIFE PRESERVING EQUIPMENT

[76] Inventor: Irwin D. Prager, 34 Malone Ave., Staten Island, N.Y. 10306

[21] Appl. No.: 591,856

[22] Filed: Mar. 21, 1984

[51] Int. Cl.[4] ..... B63C 9/16; B63C 9/24

[52] U.S. Cl. ..... 441/94; 441/42

[58] Field of Search ..... 441/42, 92–97

[56] References Cited

U.S. PATENT DOCUMENTS

| | | | |
|---|---|---|---|
| 3,128,481 | 4/1964 | Davison, Jr. | 441/94 |
| 3,173,162 | 3/1965 | Elder, Jr. | 441/94 |
| 3,828,381 | 8/1974 | Prager | 441/93 |
| 3,947,908 | 4/1976 | Maslenikow | 441/93 |
| 3,975,785. | 8/1976 | Stadeker | 441/93 |
| 4,184,216 | 1/1980 | Saleen | 441/93 |

FOREIGN PATENT DOCUMENTS

| | | | |
|---|---|---|---|
| 1184235 | 3/1970 | United Kingdom | 441/42 |

*Primary Examiner*—Sherman D. Basinger

*Attorney, Agent, or Firm*—Eugene E. Geoffrey, Jr.

[57] ABSTRACT

Life preserving equipment in the form of an elongated housing having an open side and a cover for said housing hinged at one end thereto, an inflatable member having a compressed gas cartridge including a diaphragm within the member including a cartridge puncturing pin and cooperating lever and levers carried by the housing and cover and operable upon opening of the cover to actuate the cooperating lever and force the pin into the diaphragm to permit the discharge of gas into the member for inflation thereof and a cord tethering the member to the housing.

7 Claims, 10 Drawing Figures

Fig.1.
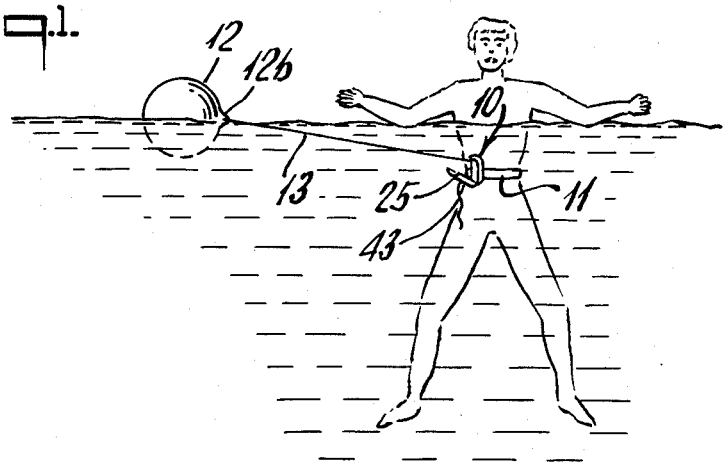
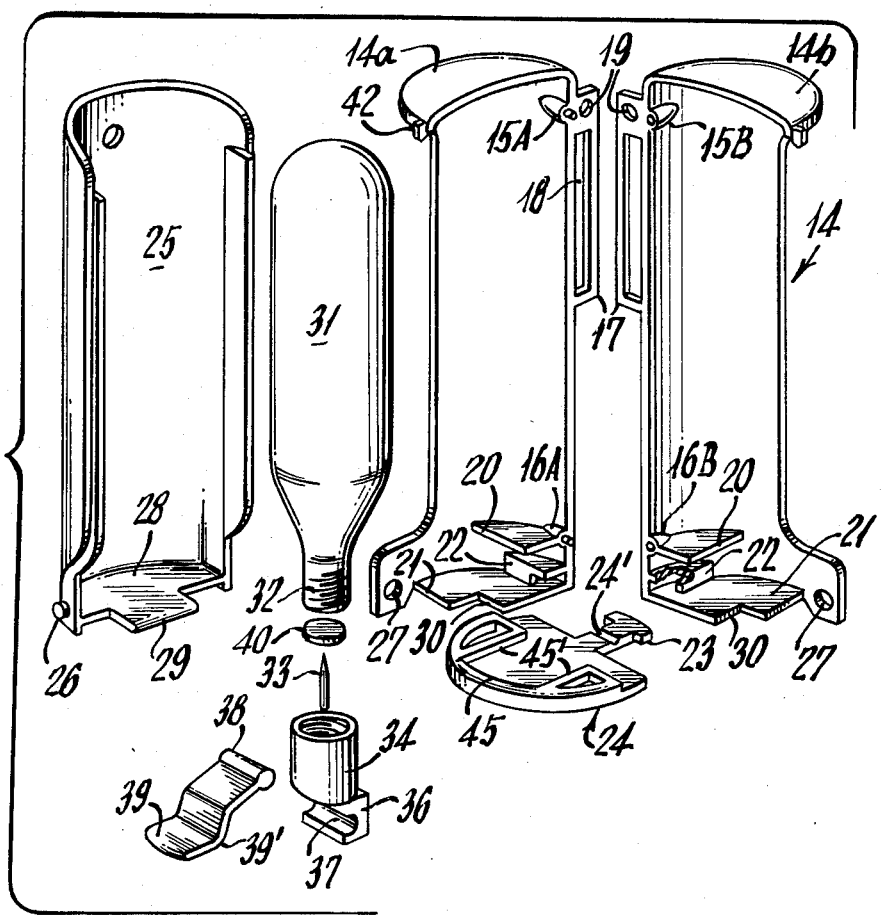
Fig.2.

42
13
14a
22
3
3
14b
20

12
12b
13

50
13

42
10
14
19
12a
13
17
18
12
31
32
25
12b
40
33
39
35
36
45
38
43
25
39
20
37
29
22
26
24
24'
23

LIFE PRESERVING EQUIPMENT

This invention relates to emergency life preserving equipment for persons on or in the water such as swimmers, divers and the like and more specifically to novel and improved life preserving equipment including an inflatable member that may be conveniently worn by the user and easily operated in the event of an emergency to release and inflate said member which is tethered to the user.

The equipment, in accordance with this invention, constitutes an improvement of the apparatus disclosed in prior U.S. Pat. No. 3,828,381 entitled "Safety Swim or Safety Float Emergency Float" granted applicant herein on Aug. 13, 1974. The equipment of the instant application is more reliable and rugged than prior known devices in that the possibility of accidental inflation of the inflatable member is extremely remote and operation to effect inflatation of the member is positive and presents negligible chance of rupturing the inflatable member.

Another object of the invention resides in the provision of a novel and improved life preserver for use by persons on or in the water which is compact, can be readily carried by the user in an accessible location for operation and is economical to manufacture.

A further object of the invention resides in the provision of a novel and improved life preserver in the form of a capsule-like device which may be fastened to the user's belt in a position to facilitate actuation for the inflation of a self-contained inflatable member.

Still another object of the invention resides in the provision of a novel and improved life preserver.

The above and other objects and advantages will become more apparent from the following description and accompanying drawings forming part of this application.

IN THE DRAWINGS

FIG. 1 is a view of a person in the water with the life preserving equipment in accordance with the invention activated to inflate a flotation member tethered to the user;

FIG. 2 is an exploded perspective view of the invention omitting the inflatable member for purposes of clarity;

Figure 3:
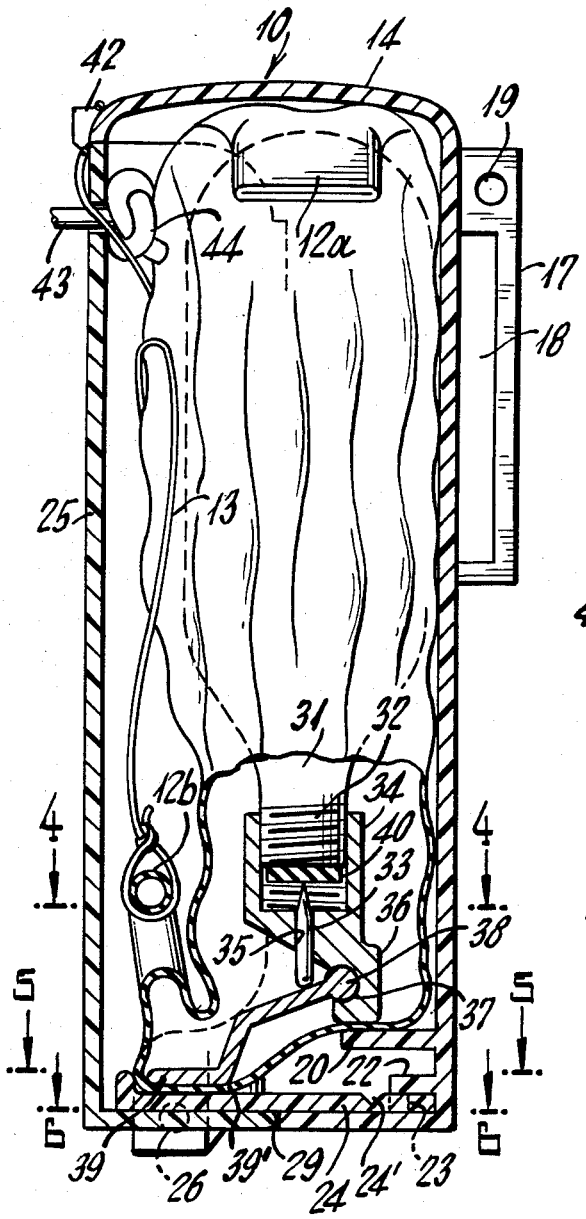
FIG. 3 is a cross sectional view of FIG. 7 taken along the line 3—3 thereof.
Figure 4:
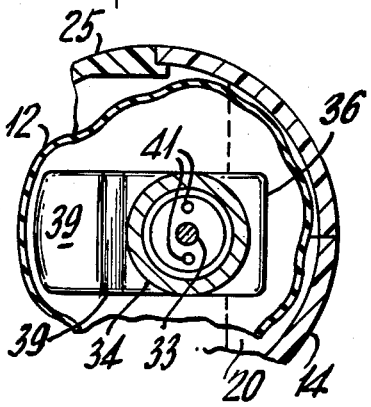
Figure 5:
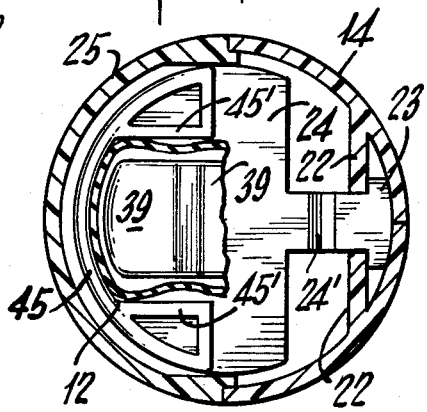
Figure 6:
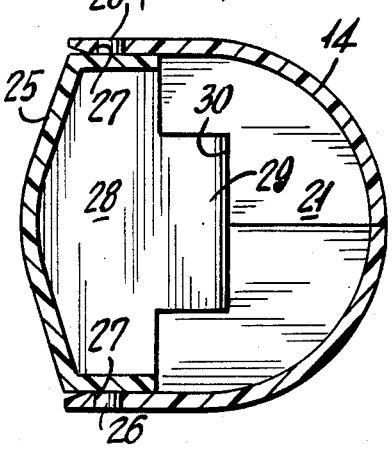
Figures 7, 8, 9A, 9B:
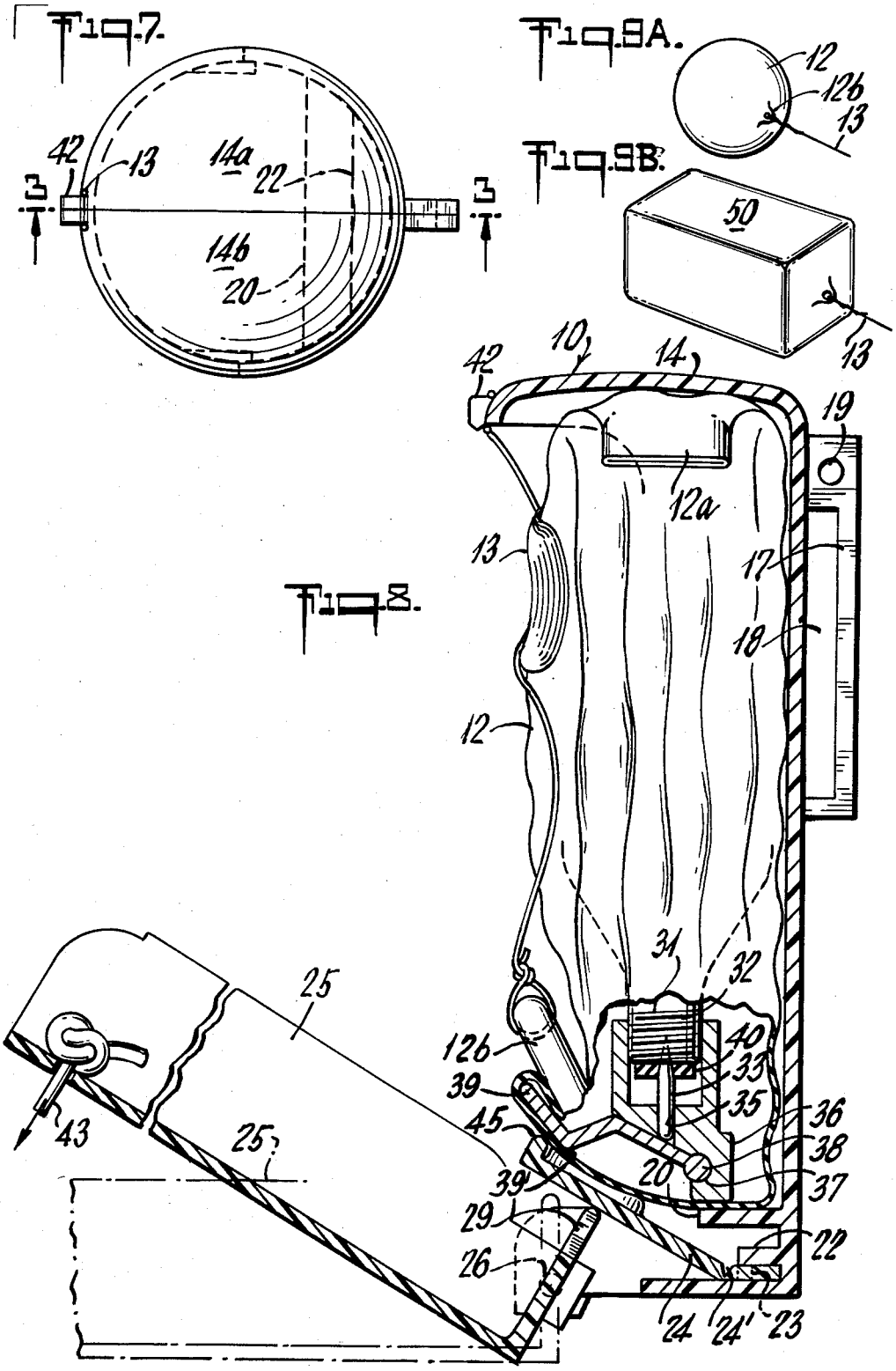

FIGS. 4, 5 and 6 are cross sectional views of FIG. 3 taken along the lines 4—4, 5—5 and 6—6 thereof, respectively;

FIG. 7 is a top view of the equipment shown in FIG. 3;

FIG. 8 is a view similar to FIG. 3 illustrating the operation of the equipment as the cover is opened; and FIGS. 9A and 9B illustrate forms of a flotation member that may be utilized with the equipment in accordance with the invention.

Referring now to the drawings, FIG. 1 illustrates generally the operation of the life preserving equipment in accordance with the invention and it will be observed that the equipment, generally denoted by the numeral 10, is carried on the belt 11 of the user and upon operation, the inflatable or flotation member 12 has been filled with gas and is tethered to the equipment 10 by a line 13. In this way, the user can employ the flotation member to assist in staying afloat and with the flotation member 12 being formed of a brightly colored material, it can be spotted more readily from a distance..

The basic elements of the equipment, in accordance with the invention, are shown in FIG. 2 while the assembled equipment is illustrated in FIG. 3. The equipment, generally denoted by the numeral 10, includes a housing portion 14 which may be formed in two companion parts denoted by the numerals **14*a* and 14*b* which may be snapped, cemented or otherwise welded together to form the completed housing portion 14. When the housing portions 14*a* and 14*b* are assembled to form the completed housing 14, which is essentially cylindrical in configuration, the aligning means 15*a*, 15*b* and 16*a*, 16*b* may be utilized to either releasably hold the two housing portions together or function merely as aligning means. The completed housing thus formed includes an elongated member 17 on the back side thereof as shown in FIG. 3 which includes an elongated opening 18 for affixing the equipment to the belt of the user or if desired a hole 19 is provided to engage some other type of fastening means. The bottom of the housing includes a shelf 20, a bottom 21 and locking means 22 for receiving and holding the T-shaped end portion 23 of a buffer arm generally denoted by the numeral 24. Engagement of the buffer arm 24 and the holding means 22 is shown more clearly in FIG. 5. The cover 25 is generally of arcuate configuration having pins 26 for engaging cooperating openings 27 in the housing portions 14*a* and 14*b* so that the cover can be pivoted relative to the housing. The cover 25 further includes a bottom 28 having a narrowed extending portion 29. The portion 29 of the bottom 28 engages a corresponding recess 30 in the bottom 21 of the housing 14 and constitutes, as will be shown, a slide arm for engaging the buffer arm 24 and pivoting it upwardly about the V-groove 24' when the equipment is activated to inflate the flotation member 12 as the cover 25 is pivoted outwardly as will be discussed in connection with FIG. 8. If desired, the holding means 22 for the buffer arm 24 can be arranged to permit the buffer arm to pivot upwardly about the ears 23**.

The cartridge 31 containing compressed gas, such as carbon dioxide, has a threaded end portion 32 of conventional construction and a diaphragm or seal closing the opening extending through the threaded end portion and which diaphragm is adapted to be ruptured by a pointed pin 33. A threaded cap 34 has a central opening 35, as shown more clearly in FIGS. 3 and 4, for slidably receiving the pin 33. The cap threadably engages the threaded end portion 32 of the cartridge 31 and the bottom of the cap 34 includes a block-like element 36 having a transverse groove 37, the latter having an angular length slightly in excess of 180° for rotatably receiving the cylindrical end portion 38 of the actuating lever 39 so that the latter can pivot upwardly to urge the pin 33 into engagement with and puncture the diaphragm or seal in the end portion 32 of the cartridge 31. If desired, a rubber disc 40 can be positioned between the pointed end of the pin 33 and the cartridge so that after the pin 33 punctures the cartridge 31, the rubber disc 40 will function to slightly withdraw the pin from the punctured opening. The cap 34, as viewed more clearly in FIG. 4, includes one or more openings 41 to facilitate discharge of the gas into the inflatable member 12 after the seal on the cartridge 31 has been punctured.

As will be observed more clearly in FIGS. 3 and 8, the cartridge 31, rubber disc 40, pin 33, cap 34 and activating lever 39, in this embodiment of the invention, are all inserted within the inflatable member 12 through the top opening 12*a*. The member 12 is then gathered within the housing portion 14 and may be tethered thereto by a cord fixed at one end to the inflatable member 12, such as the loop 12*b* and at the other end to a protruding element such as the snap lock 42 on the housing portion 14 which normally holds the cover 25 in a closed position. It will also be observed that when the cartridge 31 and the associated activating mechanism is enclosed in the housing 14, the bottom edge of the block portion 36 of the cap 34 rests on the upper surface of the shelf 20, with a portion of the inflatable member 12 disposed therebetween, to maintain the cartridge in an elevated position within the housing 14 and prevent any accidental downward motion of the cartridge 31 which may be caused by dropping the equipment on a hard surface and thus prematurely puncture the diaphragm or seal on the bottom of the cartridge 31.

In order to facilitate operation of the equipment and inflation of the float or member 12, a flexible cord 43 or other suitable means is affixed to the housing cover 25, as for instance knotting the cord as illustrated by the numeral 44 within the cover 25.

Operation of the apparatus described above will be observed more clearly from FIGS. 3 through 8 and more specifically, FIG. 8. Prior to activation, the equipment is in the position shown in FIG. 3 with the buffer arm 24 lying flat against the bottom portions of the housing 14 and cover 25. In addition, the activating lever 39 is in the downward position with the outer end of the activating lever 39 being formed to lie flat against the buffer arm 24 and is held between walls 45' of buffer arm 24. Inflation of the member 12 is accomplished merely by pulling on the cord 43 to displace the cover 25 angularly relative to the housing 14, as shown in solid outline in FIG. 8. In so doing, the portion 29 of the cover 25 is pivoted upwardly about the pivots 26 and functions to deflect the buffer arm 24 upwardly about the V-groove 24'. As this happens, the knee portion 39' of the activating arm 39 causes deflection of the outer end of the arm upwardly above the outer edge portion 45 of the buffer arm 24 whereupon the outer edge portion 45 of the buffer arm 24 rides beneath the outer end of the activating arm 39 as shown in FIG. 8 and deflects the activating arm upwardly to puncture the cartridge and thus cause inflation of the member 12. The edge portion 45 prevents displacement of the activating arm forwardly during its initial upward movement. When the cover 25 is moved outwardly to approximately the full line position, as shown in FIG. 8, the pin 33 will have reached its maximum uppermost position and the cartridge 31 will be displaced slightly rearwardly and upwardly. This permits the cover to be moved to at least the 90° position, as shown in dotted outline, so that it will not interfere in any way with the inflation of the float or member 12. It will be observed that no matter how far out the cover 25 may be displaced by the user, inflation starts to occur as soon as the cartridge is punctured and the inflatable member 12 will then function to displace the cover 25 far enough outwardly to permit complete inflation of the member 12 and its discharge from the housing 14. The rubber washer 40 disposed between the pin 33 and the cartridge 31 functions to effect slight withdrawal of the pin after the slide arm 29 moves beyond a position, normal to the buffer arm 24, as shown in FIG. 8. In the case where the elements 15*a*, 15*b* and 16*a*, 16*b* are in the form of snaps holding the housing portions 14*a* and 14*b* in engagement one with the other, inflation of the member 12, upon opening of the cover 25 can separate the housing parts 14*a* and 14*b* to facilitate release of the member 12. It will also be noted that all portions of levers in direct contact with the inflatable member 12, including the buffer arm 24 and actuating lever 39 are rounded to prevent damage thereto and the slide arm 29 also has a rounded end portion so that it will slide readily along the bottom surface of the buffer arm 24.

The inflatable member or float 12 has been generally described as being spherical in configuration when inflated, such as that shown in FIG. 9A. However, the float may take any desirable configuration, as for instance, the rectangular configuration such as that denoted by the numeral 50 in FIG. 9B or any other desirable configuration.

While only certain embodiments of the invention have been illustrated and described, it is apparent that alterations, changes and modifications may be made without departing from the true scope and spirit thereof.

What is claimed is:

1. Life preserving equipment comprising an open sided housing to be carried by the user including a cover therefor, said housing containing an inflatable member tethered to the housing, said inflatable member enclosing a compressed gas cartridge including a diaphragm and a puncture mechanism therefor including a puncturing element and an actuating arm pivotally supported relative to said cartridge, engaging said puncturing element and extending outwardly therefrom, first lever means pivotally carried by said housing externally of said inflatable member and underlying said pivotally supported arm and second lever means carried by said cover and movably upwardly upon displacement of said cover, said second lever means engaging and displacing said first lever means upwardly upon displacement of said cover relative to said housing to apply pressure to said pivotally supported actuating arm at a point spaced outwardly from said puncturing element to effect release of said gas and inflate said member.

2. Life preserving equipment according to claim 1 wherein said puncture mechanism includes a cap secured to said cartridge and enclosing said diaphragm, said cap having an opening therein normal to said diaphragm, said puncturing element is a pointed pin slidably carried by said opening and said cap further includes at least one passage for discharging gas into said member upon puncture of said diaphragm and means for pivotally supporting said pivotally supported actuating arm.

3. Life preserving equipment according to claim 2 including a shelf carried by said housing and engaging said member and cap to hold said cap and cartridge in spaced relationship to said first lever means and prevent accidental puncturing of said diaphragm.

4. Life reserving equipment according to claim 3 wherein said housing is in the form of an elongated capsule with said cover being hinged to one end thereof, said shelf is spaced from said one end and said first lever means is disposed beneath said shelf and extends outwardly beneath said actuating arm.

5. Life preserving equipment according to claim 1 wherein said housing and cover form an elongated cylindrical capsule, and said housing is formed of two parts releasably secured one to the other and separable upon inflation of said member.

6. Life preserving equipment according to claim 5 wherein said housing parts are releasably joined by at least two snap locks each having two cooperating elements with one element of each lock carried by one housing part and the cooperating element of each lock carried by the other housing part.

7. Life preserving equipment comprising a capsule having an open-sided housing and a cover closing said housing, said cover being hinged at one edge to one end of said housing and including means for angularly displacing it relative to said housing, a sealed inflatable member having a relatively thin pliable wall, a compressed gas cartridge having a diaphragm closing one end thereof, a cap secured to said one end of said cartridge and extending outwardly therefrom, said cap having a central opening therein and positioned normally to said diaphragm, at least one additional opening extending through said cap and communicating with said diaphragm on one end and the external surface of the cap on the other end, an actuating lever pivotally carried by said cap and extending outwardly therefrom, a pin having a pointed end portion, for piercing said diaphragm, slidably carried by the first said opening and having a base portion engaging said actuating lever, said inflatable member enclosing said cartridge, cap, pin and actuating lever, means in said housing for holding said cartridge with said cap and actuating lever spaced from said one end of said housing with said actuating lever projecting outwardly from said cap, a buffer arm hinged at one end within said one end of said housing and extending outwardly therefrom with the outer end thereof on the outer side of said inflatable member and beneath said actuating lever, and means carried by said cover and adjoining said one edge thereof, the last said means including a slide arm extending into said housing and beneath said buffer arm whereupon said cover upon being opened causes the inner end of said slide arm to tilt upwardly and engage said buffer arm which in turn is pivoted upwardly and displaces the actuating lever upwardly forcing said pin upwardly to puncture said diaphragm and effect inflation of said member.

* * * * *